US005355052A

United States Patent [19]

Ugrósdy et al.

[11] Patent Number: 5,355,052

[45] Date of Patent: Oct. 11, 1994

[54] HIGH PRESSURE DISCHARGE LAMP WITH GETTER

[75] Inventors: László Ugrósdy; György Horváth, both of Budapest, Hungary

[73] Assignee: Tungsram Részvénytársaság, Budapest, Hungary

[21] Appl. No.: 78,481

[22] Filed: Jun. 16, 1993

Related U.S. Application Data

[63] Continuation of Ser. No. 826,078, Jan. 27, 1992, abandoned.

[30] Foreign Application Priority Data

Jan. 31, 1991 [HU] Hungary ..... 330/91

[51] Int. Cl.[5] ..... H01J 61/24

[52] U.S. Cl. ..... 313/558; 313/25

[58] Field of Search ..... 313/558, 559, 25, 560, 313/562

[56] References Cited

U.S. PATENT DOCUMENTS

| | | | |
|---|---|---|---|
| 3,519,864 | 7/1970 | Gungle et al. | 313/25 |
| 3,626,229 | 12/1971 | Spacil et al. | 313/25 |
| 3,996,487 | 12/1976 | Hoeh | 313/25 |
| 4,367,432 | 1/1983 | Glenny et al. | 312/25 X |
| 4,855,643 | 8/1989 | White | 313/553 |
| 4,961,020 | 10/1990 | Strok | 313/25 |

FOREIGN PATENT DOCUMENTS

| | | |
|---|---|---|
| 165587 | 12/1985 | European Pat. Off. . |
| 3324081 | 3/1984 | Fed. Rep. of Germany . |
| 3346130 | 7/1984 | Fed. Rep. of Germany . |
| 2125615 | 1/1985 | United Kingdom . |

OTHER PUBLICATIONS

"High Pressure Sodium Lamps", SAES Getter Catalog (1982).

"Fényforrások", Debreczeni, et al., p. 153, Budapest (1985).

*Primary Examiner*—Sandra L. O'Shea

*Attorney, Agent, or Firm*—Schweitzer Cornman & Gross

[57] ABSTRACT

A high pressure discharge lamp, comprising an inner discharge tube, an outer envelope, current leads, a lamp stem in the outer envelope for containing the current leads, a longitudinal axis, a getter holder having a surface with getter thereon for increasing the service life of the lamp, the surface of the getter holder being located adjacent to and facing the lamp stem at a maximum angle of 90° with the longitudinal axis.

4 Claims, 1 Drawing Sheet

HIGH PRESSURE DISCHARGE LAMP WITH GETTER

This is a continuing application of U.S. Ser. No. 826,078, filed on Jan. 27, 1992, now abandoned.

FIELD OF THE INVENTION

The present invention relates to a high-pressure discharge lamp with a getter for increasing service life.

BACKGROUND OF THE INVENTION

Earlier, the space between the discharge tube and the envelope of discharge lamps was filled with inert gas, as shown for instance in the European patent application No. 165,587. The role of the inert gas was to eliminate oxidation of the metal elements in the discharge tube. A further advantage of applying inert gas was that it increased the breakdown voltage in the envelope and due to this no breakdown occured between metal elements of the discharge tube. On the other hand, however, the heat loss due to the convenction flow of the inert gas decreased the efficiency of the whole lamp.

That was the reason that later vacuum has been produced between the envelope and the discharge tube of discharge lamps and the remaining gases were bound by a getter film in the vacuum space after fusing the end of the exhaust tube of the lamp. In this way, the pressure in the vacuum space could be held below $10^5$ mbar (see Debreczeni et al: Fényforrások, Budapest, 1985, page 153). This pressure could be held during the entire thousand to over ten thousand hours service life of the lamp.

The getter in the envelope has to bind the gases remaining after pumping out the air as well as gases released and escaped from the discharge tube during operation.

During operation of the discharge lamps mainly hydrogen and oxygen are released and therefore it is reasonable to apply getter material which is capable of binding both gases. A barium getter film applied in electronics is highly active, binds the gases quickly and keeps them permanently bound in rather big quantities. In the case of high-pressure discharge lamps, however, the barium-film is warmed by the heat radiated by the discharge tube and, in this way, the hydrogen binding activity is not sufficiently effective (SAES Getter Catalog, 1982, page 28). Therefore, combined (evaporated and metal) getters are generally applied, which are able to bind the remaining gases as well as those ones which release during operation.

According to the U.S. Pat. No. 3,626,229, zirconium, titanium or zirconium-titanium alloys are used for binding hydrogen and maintaining a pressure of below $10^{-7}$ atmosphere. According to U.S. Pat. No. 3,519,864 $BaO_2$ getter is used for binding hydrogen. The most often applied getter material for maintaining the required pressure is however, a barium-film evaporated to the inner surface of the neck part of the envelope. The pure barium itself is generally produced by heating a $BaAl_4$ intermetallic alloy into the range of 900°–1000° C. within the envelope. The releasing barium can be evaporated at the above temperature range quickly and without remaining by e.g. induction heating.

German published patent application No. 3,346,130 discloses a discharge lamp wherein such a getter film is produced in the vacuum space between the envelope and discharge tube, at the lower part of the inner surface of the envelope.

The value of the pressure in the envelope of the high-pressure discharge lamps has a considerable influence on the concentration of the contaminating materials in the discharge space as the electric strength of the envelope and in this way, to the ignition characteristics and service life of the lamp, because the gases in the vacuum space penetrate into the discharge tube by diffusion and so they contaminate the discharge space as well. On the other hand, the metal parts in the envelope can easily bind oxygen and, accordingly, a quick oxidation occurs if oxygen is present in vacuum space. If hydrogen can diffuse into the discharge space, it would influence the ignition characteristics and other operation parameters of the lamp.

DESCRIPTION OF THE INVENTION

The object of the present invention is to solve the problems of prior art lamps and to provide a getter system which can bind both oxygen and hydrogen releasing during operation of the lamp, without applying a further getter material.

As it is known in electronics, a barium-film is highly active, can bind and keep bound relatively high amounts of contaminating gases. The only problem arises when hydrogen adsorption is desired at higher operative temperatures (SAES Getter Catalog, 1982, page 28). For binding oxygen, however, a higher temperature (300°–400° C.) is advantageous.

The present invention is based on the recognition that a getter film may be produced for binding both hydrogen and oxygen, if a getter ring and a getter film is arranged according to the invention.

For adsorbing hydrogen, applying a high surface getter film on the lower part of the inner surface of the envelope is the best way, because here is the lowest temperature (120°–250° C.) during operation. At the same time, for absorbing oxygen, a small surface tick layer of getter should be applied in a region, where the temperature is higher then 350°–420° C. According to the invention, a getter film may be produced by a single getter ring and the produced getter system is capable to bind effectively both hydrogen and oxygen.

The high-pressure discharge lamp according to the invention has a discharge tube, an outer envelope, current lead, a lamp stem in the outer envelope for containing the current leads, a notional axis disposed perpendicularly to said lamp stem, a getter holder having a surface with getter thereon for increasing the service life of the lamp, said surface of the getter holder being located adjacent to and facing said lamp stem at a maximum angle of 90° with said notional axis.

The angle between the surface of the getter material and geometrial axis of the lamp is advantageously between 30 and 45°.

The getter ring may be arranged opposite to the narrower side of the pinch of the stem, according to an embodiment of the invention. According to another embodiment, the getter ring may be arranged opposite to the wider side of the pinch of the stem.

In the lamp according to the invention, the barium releasing from the getter ring during induction heating impacts on the side surface of the stem and produces a rather thick layer in a high temperature region, which is just required for binding oxygen.

Another, smaller part of the barium is deposited directly on the inner surface of the lower part of the envelope or is directed to lower part of the envelope by the pinch the part of the stem. Yet another part reaches a colder place by diffusion and therefore, a thin film is produced. These thin films in regions of low temperature are just required for adsorbing hydrogen.

DESCRIPTION OF THE DRAWING

Further details and advantages of the present invention are described with reference to the sole accompanying drawing, showing a high-pressure discharge lamp, partly in section.

The discharge lamp shown in FIG. 1 has an outer envelope 1, which contains a pinched stem 2 provided with an exhaust tube 3. There is a current lead 4 and a discharge tube 5 connected to the pinched stem 2.

Figure 1:
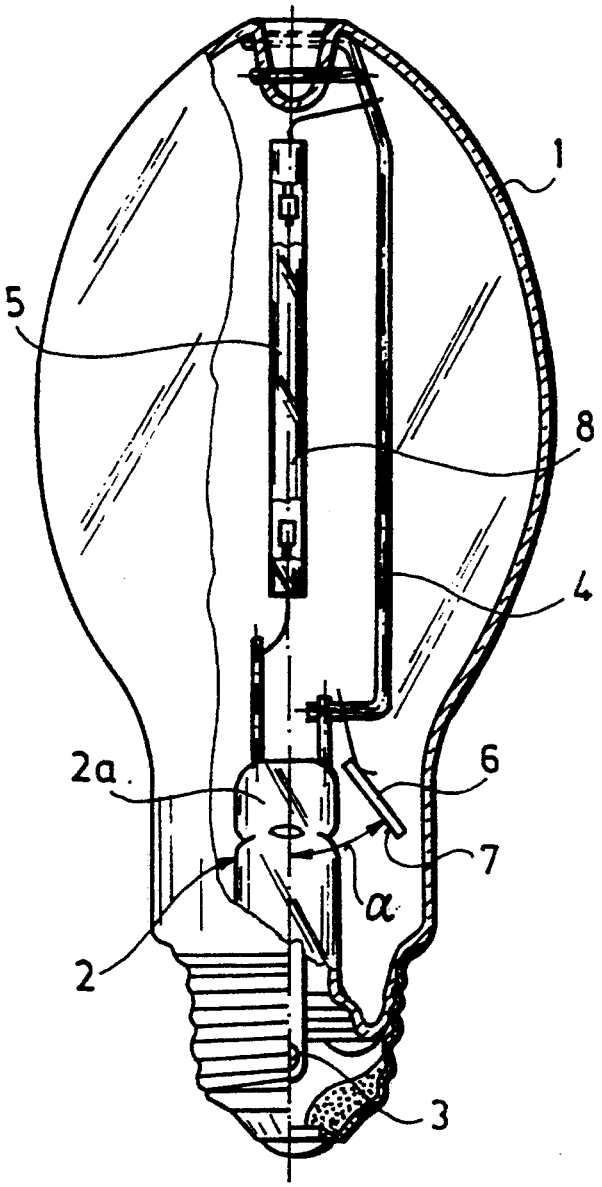

A getter ring 6 with getter material 7 is connected with the current lead 4 in a way that the surface of the getter material 7 in the getter ring 6 includes an angle with the longitudinal axis of the lamp shown in FIG. 1 by a dot-dash line, which angle is about 30°–45°. The getter material 7 may be for instance $BaAl_4$ and its surface is just opposite to the narrower side of the pinched part of the stem 2.

If the getter material 7 is evaporated from the getter ring 6 by heating, 60% of the barium is deposited to the surface of the pinched part of the stem 2. The other part of the barium produces a thin film on the lower part of the inner surface of the envelope 1. Accordingly, the getter film on the high temperature stem can bind hydrogen and the getter film on the low temperature surface of the envelope can bind oxygen from the vacuum space between the envelope and the discharge tube.

According to the convenional lamps, the whole getter film was produced on the lower part of the inner surface of the envelope, and, therefor was not capable to bind hydrogen during operation.

It should be noted that the geometrical arrangement and the heat distribution of different types of discharge lamps are different and depend on the performance of the lamps and in other cases it may be better if the surface of the getter material is opposite to the wider side of the pinch of the stem. It has been found that in lamps having an outpout of above 150 W it is generally more advantageou, if the getter ring is opposite to the narrower side of the pinch.

We claim:

1. A high pressure discharge lamp, comprising an inner discharge tube, an outer envelope, current leads, a pinched lamp stem in the outer envelope for containing the current leads, said pinched lamp stem having a narrower part and a wider part, a longitudinal axis disposed perpendicularly to said pinched lamp stem, a getter holder having a surface with getter thereon for increasing the service life of the lamp, said surface of the getter holder being located adjacent to and facing said narrower part of said pinched lamp stem at less than 90° with said longitudinal axis.

2. The high pressure discharge lamp of claim 1, wherein said angle is from about 35° to about 45°.

3. The high pressure discharge lamp of claim 1, wherein said getter holder is a ring.

4. The high pressure discharge lamp of claim 2, wherein said getter holder is a ring.

* * * * *